US010604319B2

(12) United States Patent
Alimuddin et al.

(10) Patent No.: US 10,604,319 B2
(45) Date of Patent: Mar. 31, 2020

(54) PACKAGING FOR A MULTIPART LANDSCAPE LIGHTING UNIT

(71) Applicant: Home Depot Product Authority, LLC, Atlanta, GA (US)

(72) Inventors: Linarso Alimuddin, Atlanta, GA (US); Bentley Chelf, Las Vegas, NV (US)

(73) Assignee: Home Depot Product Authority, LLC, Atlanta, GA (US)

( * ) Notice: Subject to any disclaimer, the term of this patent is extended or adjusted under 35 U.S.C. 154(b) by 0 days.

(21) Appl. No.: 15/842,673

(22) Filed: Dec. 14, 2017

(65) Prior Publication Data

US 2019/0185235 A1 Jun. 20, 2019

(51) Int. Cl.

| | |
|---|---|
| ***B65D 71/72*** | (2006.01) |
| ***B65D 71/50*** | (2006.01) |
| ***F21S 8/08*** | (2006.01) |
| ***F21V 21/08*** | (2006.01) |

(52) U.S. Cl.

CPC ..... *B65D 71/72* (2013.01); *B65D 71/50* (2013.01); *F21S 8/081* (2013.01); *F21V 21/0824* (2013.01)

(58) Field of Classification Search

CPC ..... B65D 85/42; B65D 71/72; B65D 71/50; B65D 25/10; B65D 5/50; B65D 1/34; B65D 5/5038; B65D 5/509; B65D 7/065; B65D 71/70; B65D 81/133; B65D 81/113; F21S 8/081; F21V 21/0824

USPC ..... 220/763; 206/419, 420, 421, 779, 756, 206/763

See application file for complete search history.

(56) References Cited

U.S. PATENT DOCUMENTS

| | | | | |
|---|---|---|---|---|
| 4,109,787 | A | 8/1978 | Klygis et al. | |
| 4,942,965 | A | 7/1990 | Comer | |
| 5,553,708 | A | 9/1996 | Lawrence et al. | |
| 5,823,338 | A | 10/1998 | Osterle et al. | |
| 7,147,100 | B1 | 12/2006 | Borg | |
| 2013/0008817 | A1* | 1/2013 | Colligan | B65D 5/5059 206/419 |

(Continued)

FOREIGN PATENT DOCUMENTS

| | | |
|---|---|---|
| CN | 102431720 | 9/2011 |
| DE | 8010527 | 9/1980 |

(Continued)

*Primary Examiner* — Anthony D Stashick
*Assistant Examiner* — L E Kmet
(74) *Attorney, Agent, or Firm* — Greenberg Traurig, LLP

(57) ABSTRACT

A packaging system protects and retains all the components of a lighting unit with a resilient binding unit. The packaging system is used for a lighting unit with a first component having a first elongate member and a second component having a second elongate member. It also includes a carrier base with a first and second aperture used to receive and hold the first and second elongate member at a first longitudinal location. The second aperture is located proximate to the first aperture. The packaging also includes a resilient binding element for holding the first and second components with a first and second ring to receive and hold the first and second elongate member at a second longitudinal location, where the second longitudinal location being spaced a distance from the first longitudinal location. The binding element is used to inhibit the first and second components from being longitudinally moved relative to each other.

13 Claims, 6 Drawing Sheets

(56) References Cited

U.S. PATENT DOCUMENTS

| | | | | |
|---|---|---|---|---|
| 2016/0280436 | A1* | 9/2016 | Taylor | B65D 71/50 |
| 2016/0311606 | A1 | 10/2016 | Mayer et al. | |

FOREIGN PATENT DOCUMENTS

| | | |
|---|---|---|
| DE | 3510958 | 10/1986 |
| GB | 444672 | 3/1935 |
| RU | 2507139 | 2/2014 |
| WO | 1993006024 | 4/1993 |

* cited by examiner

PACKAGING FOR A MULTIPART LANDSCAPE LIGHTING UNIT

BACKGROUND

Landscape lighting, such as path lighting, often includes a light head and a ground stake extending below the head. In some configurations, the light head and ground stake are detachable from each other. In such configurations, the fixture is frequently packed and shipped in a detached state to reduce package volume and accidental breakage in transit.

Shipping and transportation packaging for such landscape lighting requires several retaining features to hold each of the separate pieces that make up the lighting unit. While these additional features in the packaging lead to extra protection in transport, they can simultaneously add expense and complexity to the manufacturing process.

To the end user, extra protective packaging can often lead to a frustrating experience for the consumer when removing the product for use. Likewise, a retailer may also need to remove the lighting unit for merchandising, and protective features may impede the speed with which the store may deploy the landscape lights into some form of display.

Neither modern consumers nor manufacturers appreciate the internal or external costs of waste. Safety features within disposable packaging can add extra material and adhesives, driving up those waste costs. Even using recycled materials or similar options, these complex packages can be less affordable and less sustainable. Therefore, a minimization of material use is desirable by all.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

The packaging system is presented for a lighting unit with a first component having a first elongate member and a second component having a second elongate member. It also includes a carrier base with a first and second aperture used to receive and hold the first and second elongate member at a first longitudinal location. The second aperture is located proximate to the first aperture. The packaging system also includes a resilient binding element for holding the first and second components with a first and second ring to receive and hold the first and second elongate member at a second longitudinal location, where the second longitudinal location being spaced a distance from the first longitudinal location. The binding element is used to inhibit the first and second components from being longitudinally moved relative to each other.

Another packaging system of this disclosure is used for plurality of landscape lighting units which include a first component having a first elongate member and a second component that is physically separate from the first component, the second component having a second elongate member. The packaging system includes a container adapted to fully contain the landscape lighting units and a cardboard carrier base positioned in the container. The container using a plurality of first and second apertures sized and shaped to receive the first and second elongate members and hold the first and second elongate members at first longitudinal locations. Each of the second apertures is located proximate to a corresponding one of the first apertures. The carrier base is removable from the container to serve as a merchandising display unit. This packaging system also includes figure-eight shaped, elastomeric ties for holding the first and second components. Each tie includes a first and a second ring having a first and a second opening, respectively. Each opening defining an inner circumference of the first and second ring that is less than an outer circumference of a corresponding first and second elongate member at a second location spaced a distance from the first location thereof. The first and second ring are adapted to receive and hold the corresponding elongate member, wherein the rings at least partially inhibits longitudinal movement of the first and second component. The first and second apertures cooperate with the corresponding ties to position corresponding first and second components in generally parallel configurations relative to each other when the first and second components are positioned within the first and second apertures of the ties.

A method of packaging a lighting unit is also presented herein. The lighting unit includes a first and a second component having a first and a second elongate member. A second component is physically separate from the first component. The user connects the first elongate member of the first component to a second elongate member of the second component with a resilient binding element adapted to receive and hold the first and second elongate members at a first longitudinal location. The binding element partially inhibits the first and second components from being longitudinally moved relative to each other. The user then inserts the first and second elongate member into a first and second aperture in a carrier base, respectively, sized and shaped to receive the first and second elongate member at a second longitudinal location of the first and second elongate member. The second longitudinal location of the first and second elongate member is spaced a distance from the first longitudinal location. Finally, the user encloses the combined lighting unit and carrier base in a protective packaging system.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, and components have not been described in detail as not to unnecessarily obscure aspects of the present invention.

Generally speaking, various embodiments provide for a packaging system to securely join the components of a lighting unit for sale and transport. Lighting units, like many other multipart products that are sold in pieces, can often become damaged or separated from essential parts of the final composite device during transit. For example, a landscape lighting unit is often sold with a separate ground spike to reduce the required package volume, but that spike can be easily lost, separated from the lighting head, or simply left behind by the purchaser, thereby driving up customer complaints and high rates of returns. As such, packaging systems for these devices may include a variety of retention features to secure the lighting components together as a single, saleable unit throughout the process. The packaging systems may be further adapted to coordinate a variety of packaging components such as a transport carrier and retaining elements that interact to couple and protect the components of the lighting unit.

Figure 1:
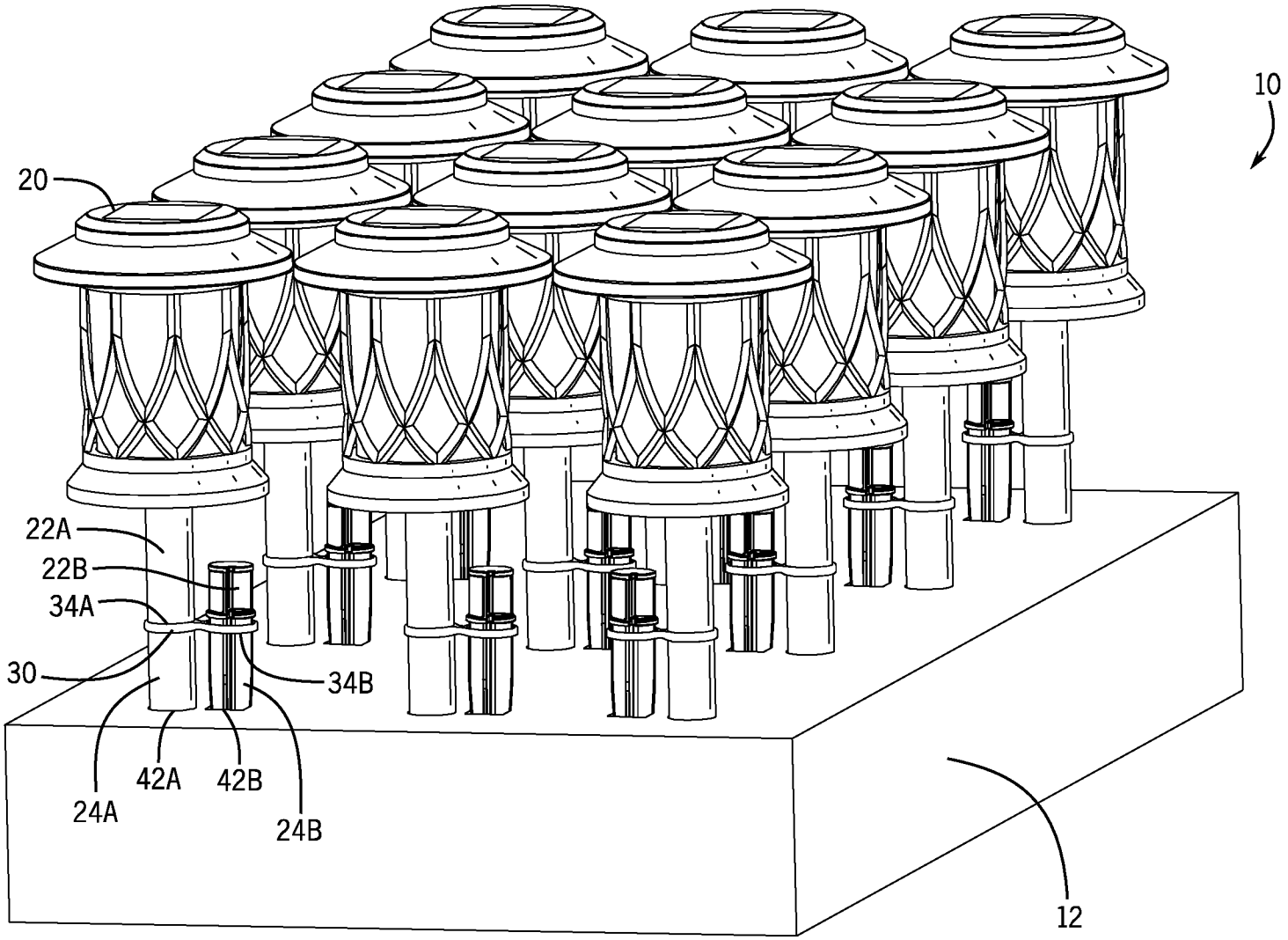
FIG. 1 is a perspective view of a packaging system according to various embodiments of the present invention.

Turning now to the figures, FIG. 1 shows a packaging system 10 which is intended as an efficient storage and retention packaging system, in accordance with various embodiments of the present invention. In the illustrated embodiment, the packaging system 10 includes a number of lighting units 20 packed using an array of apertures 40 (shown in FIG. 4) in carrier base 12. Lighting units 20 may be composed of a number of components or parts which are bound together by a resilient binding element 30 as shown and as described in more detail below.

In the illustrated embodiment, the packaged lighting unit 20 is separated into two parts while stored: a first component 22A and a second component 22B. While packaging system 10 is shown retaining landscape lighting, it should be appreciated that packaging system 10 could be configured and arranged to hold and retain various other products that are shipped and sold as multiple disassembled components.

Lighting unit 20 in the example shown is a lamp-style landscape light for use outdoors, as is often seen around paths or in household gardens. In the illustrated embodiment, first component 22A comprises a main lamp head, which may further comprise a suitable lighting element such as an LED bulb. Second component 22B comprises a ground stake for mounting the unit into the ground. In other examples, the second component 22B may be a stand, such as a tripod.

Components 22A, 22B each include respective elongate members, namely, a first elongate member 24A as the lower part of first component 22A and a second elongate member 24B as the central main body of second component 22B. In the example shown, components 22A, 22B connect together to form the full lighting unit 20 by simple insertion, and this connection is secured using a press fit. One of ordinary skill would appreciate that components 22A, 22B could also be attached in a number of other suitable ways, such as with complementary threading on matching portions of the components or using an external fastening method such as, for example, a screw or adhesive.

Binding element 30 is shown in use and positioned around two components 22A, 22B. In the illustrated embodiment, the dual ring shape of binding element 30 is positioned at a longitudinal location on each of elongate members 24A, 24B of each component 22A, 22B of the lighting unit 22. The example binding element 30 has a plurality of openings (described in more detail with respect to FIGS. 2 and 3 below), which are sized and shaped to receive and snuggly retain elongate members 24A, 24B. Binding element 30 may be constructed of an elastic material to impart resiliency in order to fit snuggly over the longitudinal location of elongate members 24A, 24B of each respective component 22A, 22B of lighting unit 22.

Carrier base 12 provides a plurality of locations and means to support lighting units 20 in transport. To that end, carrier base 12 contains a series of groupings of apertures 42A, 42B to hold elongate members 24A, 24B of each component 22A, 22B of lighting units 22. The aperture groupings together can axially position the components 22A, 22B for a tight and efficient packing arrangement. Carrier base 12 also cooperates with binding elements 30 to hold each of lighting units 22 in place as single saleable units. To do so, apertures 42A, 42B in carrier base 12 are generally axially aligned with openings 34A, 34B in the binding element 30.

Figure 2:
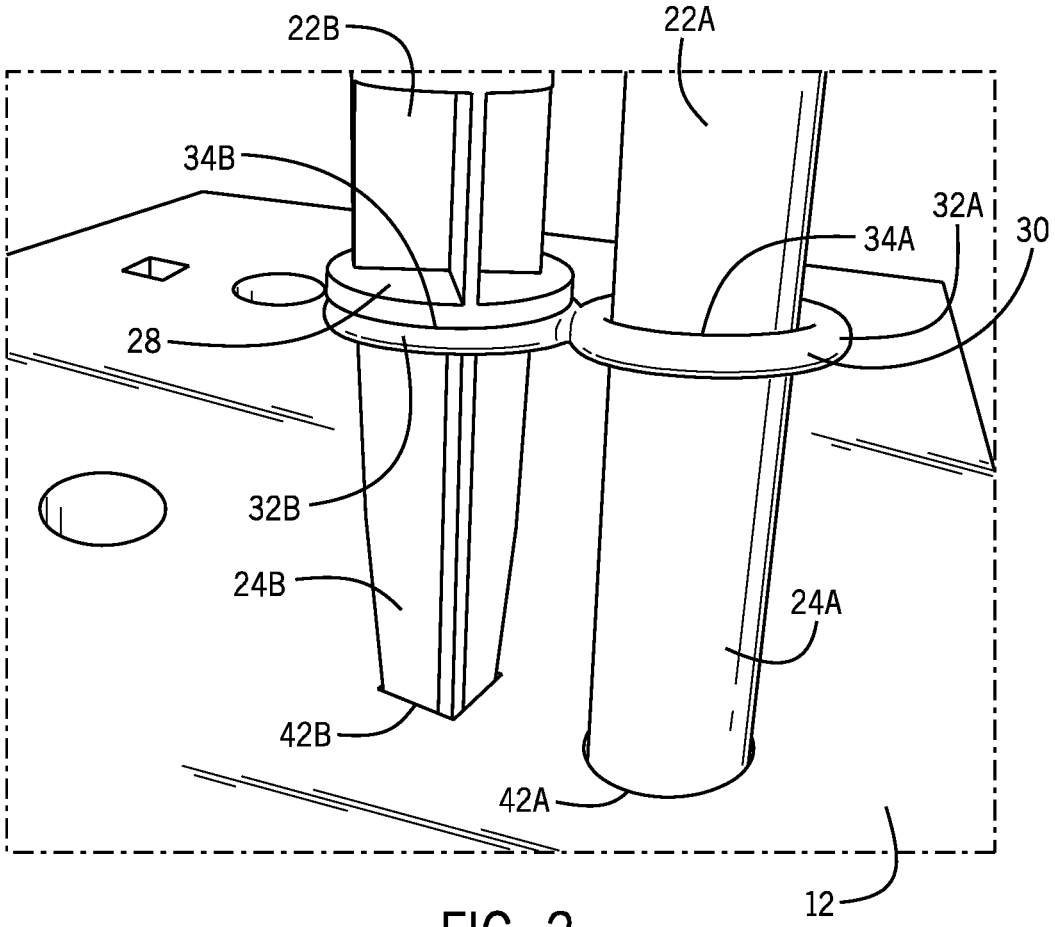
FIG. 2 is a perspective view of a packaging system for two components of a lighting unit in a packaging system, according to various embodiments of the present invention.

FIG. 2 shows a magnified view of components 22A, 22B of a single lighting unit 20 bound together with binding element 30 and positioned within apertures 42A, 42B of carrier base 12, in accordance with various embodiments of the present invention. As shown, binding element 30 is positioned at longitudinal locations of first elongate member 24A and second elongate member 24B. Similarly, openings 34A and 34B in each ring 32A, 32B, respectively are positioned at a second set of the longitudinal locations of first elongate member 24A and second elongate member 24B. In the illustrated example, a stop 28 is shown on first component 22A. Stop 28 may be a flange on the first elongate member 24A which allows retaining element 30 to be more easily located at a preferred longitudinal position for efficient packing. In other examples, stop 28 could be variety of shapes to control the location of binding element 30, such as, for example a tab on the elongate member or a small annular indentation.

These longitudinal locations for the positioning of openings 34A, 34B and apertures 42A, 42B may be selected to axially align the components 22A, 22B such that the vertical centerlines of each component 22A, 22B are properly and consistently aligned to ensure an efficiently and securely packed unit. In the example shown, the axial alignment allows for a minimal use of space with components 22A, 22B oriented substantially vertically and spaced a minimal distance from each other. In this illustrated embodiment, the axial alignment of components 22A, 22B is substantially vertical due to the shaping of the lighting unit 20 as having a vertically elongate and rotationally symmetric form. In other examples, the axial alignments could be oriented differently, such as at an angle relative to each other, for more efficiently packing more complex and disparately shaped lighting units 20.

Figure 3A:
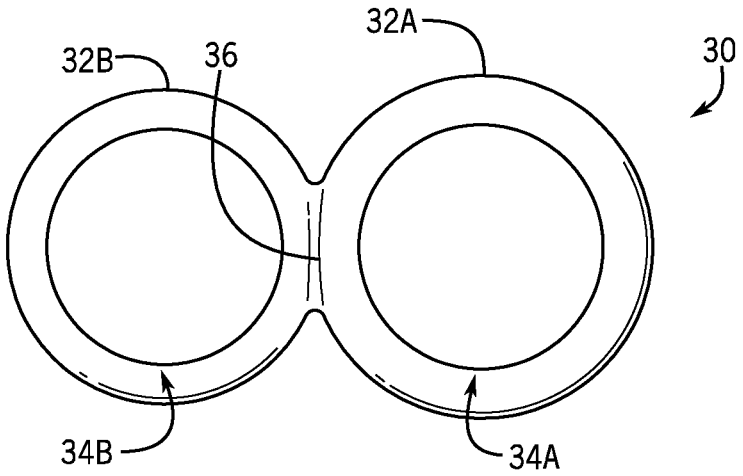
FIG. 3A is a plan view of a binding element, according to various embodiments of the present invention.

FIG. 3A shows a plan view of a binding element 30 in accordance with various embodiments of the present invention. Binding element 30 may serve as a flexible connector between the two components 22A, 22B that can stretch and bend over elongate members 24A, 24B and them compress tightly around them. In the illustrated embodiment, the binding element 30 is a dual ring, dual opening design. Rings 32A, 32B are each formed in a generally toroidal shape and may be connected at a contact point 36. Binding element 30 can be constructed of a variety of resilient materials, including thermoplastic and other elastomeric materials. In some embodiments, rings 32A, 32B are formed in a single piece, while in other embodiments the two rings 32A, 32B are joined by welding, adhesives, or other suitable joining means operating at contact point 36.

Binding element 30 includes openings 34A, 34B which are sized and shaped to receive elongate members 24A, 24B at a specific longitudinal point and hold elongate members 24A, 24B at a specific location for efficient and safe packaging. In the embodiment shown, openings 34A, 34B are dimensioned to be smaller than elongate member 24A, 24B at the relevant longitudinal locations thereof. Because binding element 30 is resilient, rings 32A, 32B can be stretched to fit over lighting unit components 22A, 22B and then snuggly hold them. This resiliency allows binding element 30 to be installed at a specific desired point so as to bind components 22A, 22B of the lighting unit 20 together as a single saleable unit. Binding element 30 partially inhibits the first and second components 22A, 22B from being longitudinally moved relative to each other, ensuring that components 22A, 22B remain together when withdrawn from the carrier base 12.

Figure 3B:
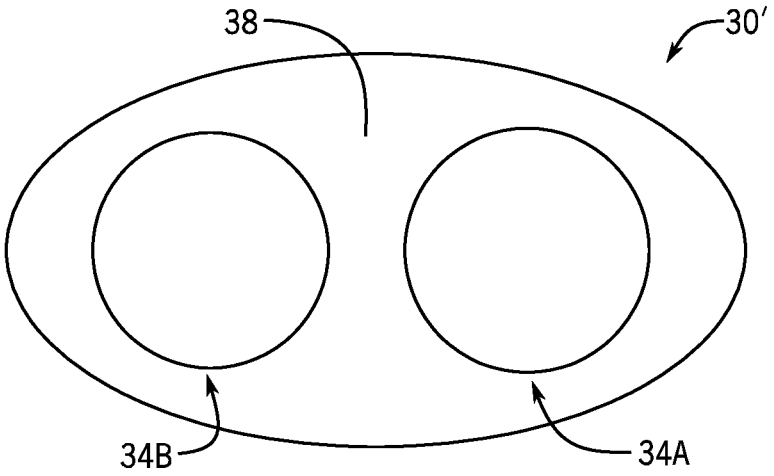
FIG. 3B is a plan view of another binding element, according to various embodiments of the present invention.

FIG. 3B illustrates another configuration of a binding element 30', in accordance with various embodiments of the present invention. In this illustrated embodiment, rather than being formed in two rings 32A, 32B, binding element 30' is formed from an oval body 38. Within body 38, openings 34A, 34B are positioned similarly as in the above illustrated embodiment of FIG. 3A. As before, openings 34A, 34B are sized and shaped to hold and retain the elongate member 24A, 24B of the lighting unit 20. In still other embodiments, body 38 of binding element 30, 30' may comprise other shapes to position openings 34A, 34B for axial alignment with the carrier base 12 as demanded by the components being secured.

Figure 4:
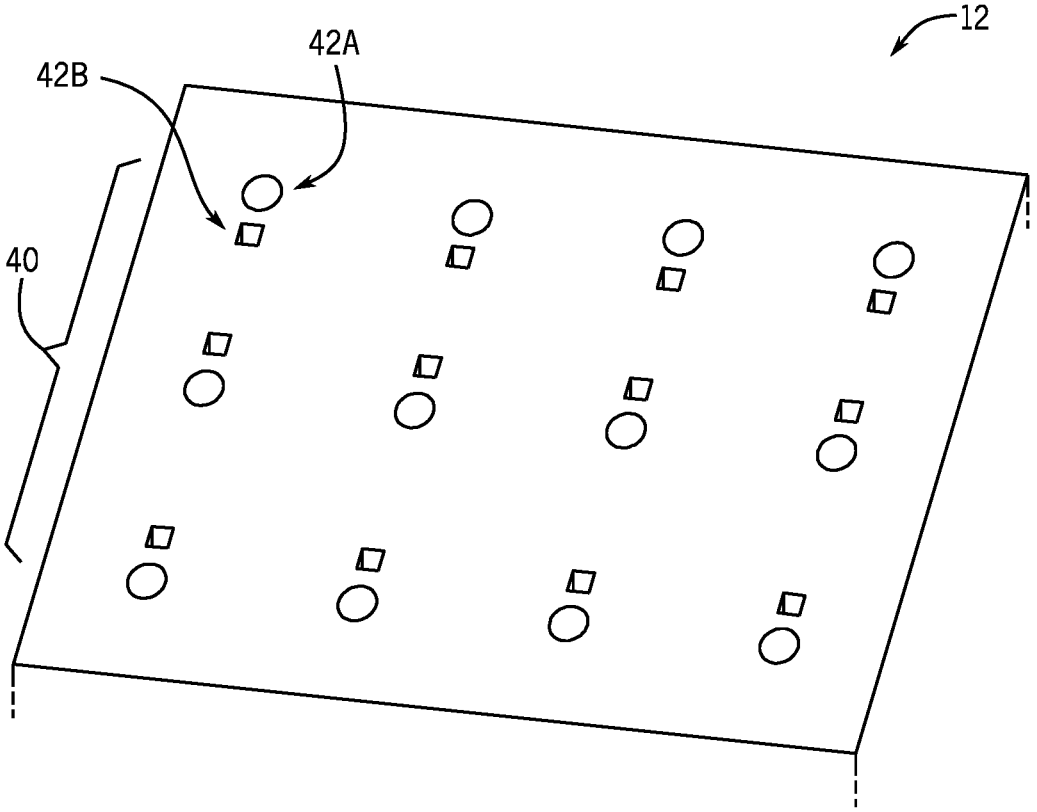
FIG. 4 is a top view of a carrier base, according to various embodiments of the present invention.

FIG. 4 shows a plan view of a carrier base 12 for holding a plurality of lighting units 20 for sale and transport, in accordance with the various embodiments of the present invention. Carrier base 12 includes a plurality of apertures 42A, 42B adapted to hold a corresponding plurality of lighting units 20. In some embodiments, groupings of one or more apertures may be arranged in an array or matrix configuration 40. In the illustrated embodiment, the groupings in the array 40 each include a first aperture 42A and a second aperture 42B which are each adapted to fit the respective elongate members 24A, 24B. Carrier base 12 is adapted to serve as a part of a container holding the objects for transport, but may also be removable to serve as a merchandising display package. In the example shown, carrier base 12 is made of cardboard, but may be made of a number of suitable packaging materials, including but not limited to corrugated and non-corrugated plastic.

Figure 5:
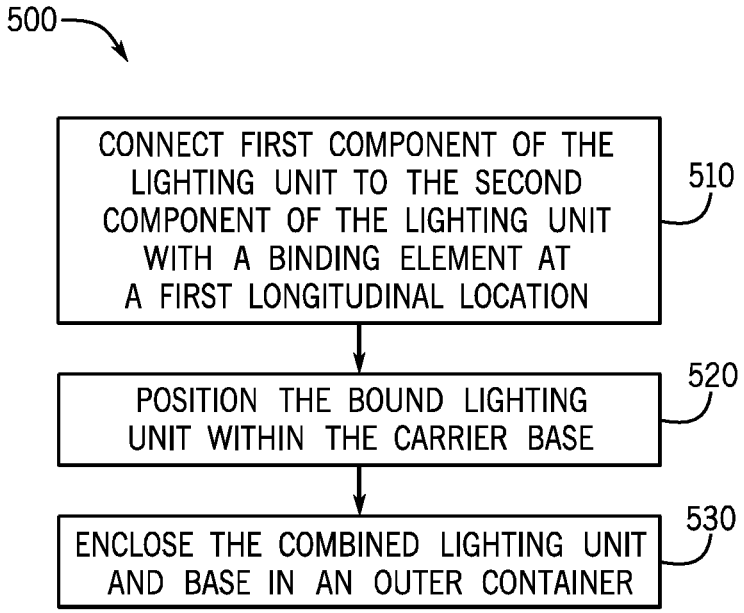
FIG. 5 is a flowchart of a process for packaging components of a multipart lighting unit into a packaging system, according to various embodiments of the present invention.
Figure 6:
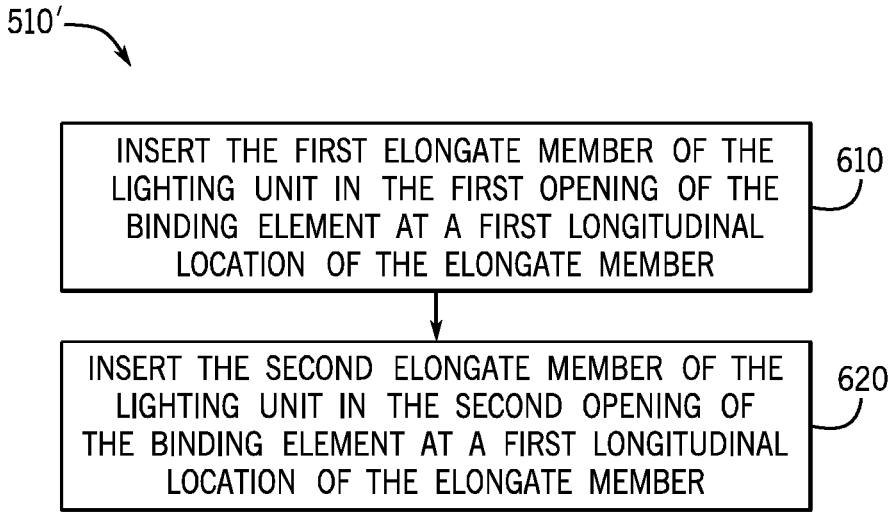
FIG. 6 is a flowchart of a process for linking components of a lighting unit with a retaining member, according to various embodiments of the present invention.
Figure 7:
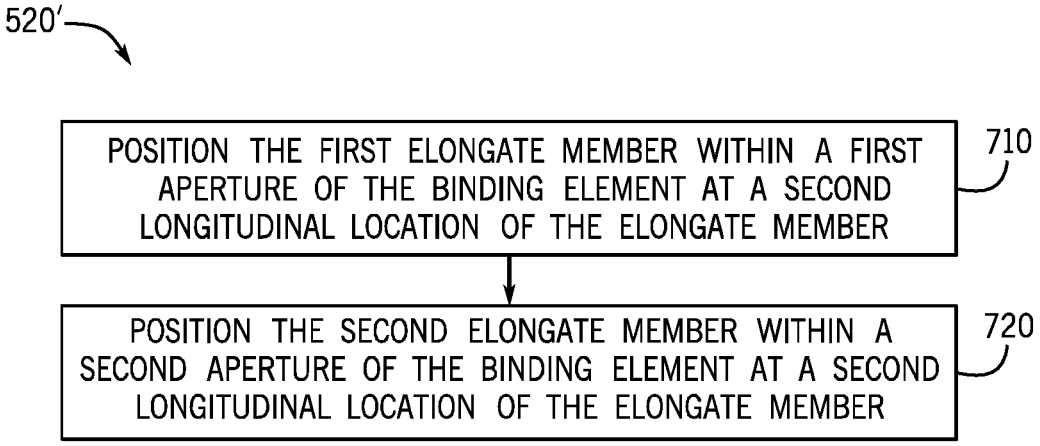
FIG. 7 is a flowchart of a process for positioning components of a lighting unit within a carrier base, according to various embodiments of the present invention.

The following discussion sets forth in detail the processes and methodology operation of packaging systems for a multipart landscape lighting unit, according to various embodiments. With reference to FIGS. 5-7, flowcharts 500, 510', and 520' each illustrate example steps used by various embodiments of the present invention in order to secure a landscape light. Flowcharts 500, 510', and 520' include processes that could be carried out by a human or a machine. Although specific operations are disclosed in flowcharts 500, 510' and 520', such operations are examples. That is, embodiments are well suited to performing various other operations or variations of the operations recited in flowcharts 500, 510' and 520'. It is appreciated that the operations in flowcharts 500, 510', and 520' may be performed in an order different than presented, and that not all of the operations in flowcharts 500, 510' and 520' may be performed. Where helpful for the purposes of illustration and not for limitation, FIGS. 5-7 will be described with reference to FIGS. 1-4 or the parts referenced therein, which illustrate hypothetical situations in which such embodiments may be implemented.

FIG. 5 is a flowchart 500 of a process of packaging the components of the lighting unit 20 in accordance with the teachings of this disclosure. At block 510, the first and second components 22A, 22B are connected using the binding element 30. Binding element 30 serves to securely receive and hold components 24A, 24B together. Binding element 30 is resilient so as to compression fit snuggly around elongate members 24A, 24B of components 22A, 22B of lighting unit 22 at a longitudinal location thereof. The axial alignment of components 22A, 22B is determined by the positioning of openings 34A, 34B in the binding element 30. It should be appreciated that this connection may be achieved in a number of ways. For example, FIG. 6 illustrates a flowchart 510' for a process of linking components of a lighting unit 20 with a retaining member 30 in accordance with various embodiments of the present invention. Flowchart 510' begins at block 610, where the elongate member 24A of first component 22A of lighting unit 20 is inserted into the first opening 34A in binding member 30. At block 620, elongate member 24B of the second component 22B of the lighting unit 20 is inserted into second opening 34B in binding member 30. By inserting elongate members 24A, 24B into the respective openings 34A, 34B of binding element 30 at matching or complementary longitudinal locations, binding element 30 creates the desired axial alignment of components 22A, 22B.

Referring again to FIG. 5, at block 520, the now combined lighting element is placed into carrier base 12 by positioning the ends of elongate members 24A, 24B into carrier base 12. In so doing, binding element 30 is positioned at a distance above carrier base 12 forming a displacement between the first and second longitudinal locations on components 22A, 22B. By securing components 22A, 22B at these various locations, carrier base 12 cooperates with binding element 30 to ensure the desired axial alignment of components 22A, 22B. In the illustrated example shown in FIG. 5, the alignment of the components 22A and 22B relative to each other is parallel and vertical. The axial alignment may be adapted to the shape of the lighting unit 20 for most efficient packaging. It should be appreciated that positioning elongate members 24A, 24B within carrier base 12 may be achieved in a number of ways. For example, FIG. 7 illustrates a flowchart 520' for a process of positioning components of a lighting unit 20 within a carrier base 12, in accordance with various embodiments of the present invention. Flowchart 520' begins at block 710, where elongate member 24A of second component 22A of the lighting unit 20 is inserted into the aperture 42A in carrier base 12. At block 720, elongate member 24B of second component 22B of the lighting unit 20 is inserted into the aperture 42B in carrier base 12. By the positioning of the first and second apertures 42A, 42B, axial alignment of lighting unit 20 is achieved by cooperation with binding element 30 and coordination of the location of first and second openings 34A, 34B and first and second apertures 42A, 42B.

Referring again to FIG. 5, at block 530, the base and lighting unit is placed in a container, e.g. for shipping to a retailer or other customer, thereby protected for transportation and delivery. The efficiently packed components 22A, 22B of each lighting unit 20 are secured together so as not to be separated from each other.

Thus, various embodiments of the present invention provide for an improved package for securing a multipart landscape lighting unit. Significantly, the embodiments discussed herein retain multiple components together throughout transportation until sale as a single unit. With conventional packaging, the parts may become separated, for example if customer picks up only part of the lighting unit. In these cases, the customer is therefore unable to install the device, becomes frustrated, and may seek to return the product, leading to customer aggravation and inconvenience and increasing cost to the retailer and/or manufacturer. In other situations, a component could become separated during transit and damaged. In either example, the various embodiments prevent high rates of customer complaints and product returns. The various embodiments can also provide for a protective arrangement that can simultaneously be used as a merchandizing display unit.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A packaging system for a lighting unit comprising a first component having a first elongate member and a second component that is physically separate from the first component, the second component having a second elongate member, the packaging system comprising:

a carrier base, including:

a first aperture sized and shaped to receive the first elongate member and hold the first elongate member at a first longitudinal location thereof; and a second aperture sized and shaped to receive the second elongate member and hold the second elongate member at a first longitudinal location thereof, the second aperture being located proximate to the first aperture; and a resilient binding element for holding the first and second components including:

a first ring adapted to receive and hold the first elongate member at a second longitudinal location thereof, the second longitudinal location of the first elongate member being spaced a distance from the first longitudinal location of the first elongate member; and a second ring adjoining the first ring and adapted to receive the second elongate member and hold the second elongate member at a second longitudinal location thereof, the second longitudinal location of the second elongate member being spaced a distance from the first longitudinal location of the second elongate member;

wherein the binding element is shaped in a figure-eight configuration, and wherein the binding element at least partially inhibits the first and second components from being longitudinally moved relative to each other.

2. The packaging system of claim 1 wherein the carrier base is comprised of cardboard.

3. The packaging system of claim 1 wherein the first and second apertures cooperate with the binding element to position the first and second components in a generally parallel configuration relative to each other when the first and second components are positioned within the first and second aperture and the binding element.

4. The packaging system of claim 1 wherein the binding element is comprised of an elastomeric material.

5. The packaging system of claim 4 wherein the elastomeric material comprises rubber.

6. The packaging system of claim 1 wherein the binding element is comprised of an elastomeric material.

7. The packaging system of claim 6 wherein the elastomeric material comprises rubber.

8. A packaging system for a plurality of landscape lighting units each comprising a first component having a first elongate member and a second component that is physically separate from the first component, the second component having a second elongate member, the packaging system comprising:

a cardboard carrier base positioned in the container and including:

a plurality of first apertures sized and shaped to receive the first elongate members and hold the first elongate members at first longitudinal locations thereof; and a plurality of second apertures sized and shaped to receive the second elongate members and hold the second elongate members at first longitudinal locations thereof; and wherein each of the second apertures is located proximate to a corresponding one of the first apertures; and wherein the carrier base is removable from the container to serve as a merchandising display unit; and a plurality of figure-eight shaped, elastomeric ties for holding the first and second components, wherein each tie comprises:

a first ring having a first opening, the first opening defining an inner circumference of the first ring that is less than an outer circumference of a corresponding first elongate member at a second location thereof that is spaced a distance from the first location thereof, the first ring being adapted to receive the corresponding first elongate member and hold the first elongate member, wherein the first ring at least partially inhibits longitudinal movement of the first component, and a second ring adjoining the first ring and having a second opening, the second opening defining an inner circumference of the second ring that is less than an outer circumference of a corresponding second elongate member at a second location thereof that is spaced a distance from the first location thereof, the second ring being adapted to receive a the corresponding second elongate member and hold the second elongate member, wherein the second ring at least partially inhibits longitudinal movement of the second component;

wherein the first and second apertures cooperate with the corresponding ties to position corresponding first and second components in generally parallel configurations relative to each other when the first and second components are positioned within the first and second apertures of the ties.

9. A packaging system for a lighting unit comprising a first component having a first elongate member and a second component that is physically separate from the first component, the second component having a second elongate member, the packaging system comprising:

a carrier base, including:

a first aperture sized and shaped to receive the first elongate member and hold the first elongate member at a first longitudinal location thereof; and a second aperture sized and shaped to receive the second elongate member and hold the second elongate member at a first longitudinal location thereof, the second aperture being located proximate to the first aperture; and a resilient binding element for holding the first and second components including:

a first ring adapted to receive and hold the first elongate member at a second longitudinal location thereof, the second longitudinal location of the first elongate member being spaced a distance from the first longitudinal location of the first elongate member, wherein the first ring comprises an inner circumference that is less than an outer circumference of the first elongate member at the second location in order to at least partially inhibit longitudinal movement of the first component; and a second ring adjoining the first ring and adapted to receive the second elongate member and hold the second elongate member at a second longitudinal location thereof, the second longitudinal location of the second elongate member being spaced a distance from the first longitudinal location of the second elongate member;

wherein the binding element at least partially inhibits the first and second components from being longitudinally moved relative to each other.

10. The packaging system of claim 9 wherein the second ring comprises an inner circumference that is less than an outer circumference of the second elongate member at the second location in order to at least partially inhibit longitudinal movement of the second component.

11. The packaging system of claim 10 wherein the binding element circumferentially encloses the first and second elongate member.

12. The packaging system of claim 9 wherein the carrier base is comprised of cardboard.

13. The packaging system of claim 9 wherein the first and second apertures cooperate with the binding element to position the first and second components in a generally parallel configuration relative to each other when the first and second components are positioned within the first and second aperture and the binding element.

* * * * *